US006675818B1

(12) United States Patent
Schrott et al.

(10) Patent No.: US 6,675,818 B1
(45) Date of Patent: Jan. 13, 2004

(54) DISHWASHING MACHINE

(75) Inventors: Harald Schrott, Lindau (DE); Gunter Biechele, Leutkirch (DE); Siegfried Hillenbrand, Albstadt (DE); Klaus Roth, Wolpertswende (DE)

(73) Assignee: Aweco Appliance Systems GmbH & Co. KG, Neukirch (DE)

( * ) Notice: Subject to any disclaimer, the term of this patent is extended or adjusted under 35 U.S.C. 154(b) by 165 days.

(21) Appl. No.: 10/030,812

(22) PCT Filed: Jul. 14, 2000

(86) PCT No.: PCT/DE00/02336

§ 371 (c)(1),
(2), (4) Date: Jan. 14, 2002

(87) PCT Pub. No.: WO01/05294

PCT Pub. Date: Jan. 25, 2001

(30) Foreign Application Priority Data

Jul. 15, 1999 (DE) ..... 199 32 659

(51) Int. Cl.[7] ..... B08B 3/02
(52) U.S. Cl. ..... 134/57 D; 134/58 D; 134/560
(58) Field of Search ..... 68/12.02, 12.05, 68/12.12, 12.16, 12.21, 13 R; 134/56 R, 58 R, 57 R, 201, 57 D, 58 D, 56 D

(56) References Cited

U.S. PATENT DOCUMENTS

| | | | | |
|---|---|---|---|---|
| 3,290,587 A | * | 12/1966 | Chafee, Jr. | |
| 3,595,267 A | * | 7/1971 | Anderson | |
| 3,870,417 A | | 3/1975 | Bashark | 356/208 |
| 5,586,567 A | * | 12/1996 | Smith et al. | |
| 5,589,935 A | * | 12/1996 | Biard | |
| 5,729,025 A | * | 3/1998 | Erickson et al. | |
| 5,822,819 A | | 10/1998 | Ferragut et al. | 8/158 |

FOREIGN PATENT DOCUMENTS

| | | | |
|---|---|---|---|
| DE | 29 11 366 A | | 10/1980 |
| DE | 40 18 048 A | | 12/1991 |
| EP | 023857 | * | 2/1980 |
| EP | 0 943 287 A1 | | 9/1999 |

OTHER PUBLICATIONS

European Patent Application 2–1980.*

* cited by examiner

*Primary Examiner*—Frankie L. Stinson
(74) *Attorney, Agent, or Firm*—Hogan & Hartson LLP

(57) ABSTRACT

A dishwasher (1) is proposed, in which the program sequence can be controlled as required. According to the invention, this is achieved by providing a radar sensor (12).

22 Claims, 1 Drawing Sheet

DISHWASHING MACHINE

BACKGROUND OF THE INVENTION

1. Field of the Invention

The present invention relates to a dishwashing machine, and more particularly, to a dishwashing machine in which the program sequence of dishwashing can be controlled more flexibly.

2. Discussion of the Related Art

Dishwashing machine normally use fixed program steps, which are controlled by electromechanical switching mechanisms, or by electronic controllers. The individual program steps are in this case always carried out in a predetermined manner, irrespective of the operating state of the machine, for example the load, the amount of dirt on the dishes or in the washing water, etc. If the spray arm is block, for example by the dishes arm is blocked, for example by the dishes being inserted incorrectly, if the nozzle are excessively dirty, etc, this results in a poor dishwashing result.

A dishwashing machine in which an optical sensor was provided for detection of the spray arm movement is known from the document DE 40 18 048 A1. This sensor unit operates in the manner of a light barrier, in which case it is possible to detect the passage of a reflective surface on the spray arm in corresponding time intervals, by means of the sensor unit.

SUMMARY OF THE INVENTION

The present invention includes a dishwashing machine having a sensor unit, by means of which it is possible to detect dynamic processes better.

A dishwashing machine according to the invention is accordingly distinguished by the provision of a Doppler radar sensor. The Doppler radar sensor allows a large number of different functions to be monitored. Overall, the capability to detect various types of operating and control parameters by means of a radar sensor allows better regulation and control and the dishwashing machine operations.

The frequency difference between the emitted and reflected wave is evaluated by means of the Doppler radar sensor. This difference, which is also referred to as the Doppler frequency, represents a measure of the relative rate of movement between the sensor and the respective reflection surface. The Doppler radar is thus particularly highly suitable for monitoring dynamic processes.

In one particular embodiment of the invention, the radar sensor is directed into the interior of the washing chamber. A radar sensor directed in such a way is able to provide information about the processes taking place inside the washing chamber. This information may relate, for example, to the washing liquid, the dishes that have been inserted, or else to the dishwasher components.

The washing chamber wall is advantageously at least partially formed from plastic, so that the radar sensor can be arranged behind this plastic, outside the washing chamber, and both the antenna and the electronic circuit, including the electrical connections, are protected from damaging influences resulting from the washing process. The radar technology itself is distinguished in that it can operate despite dirt or cloudiness in the interior of the washing chamber.

In the case of a dishwashing machine having a plastic housing, the radar sensor can be arranged at virtually any desired point on the outside of this plastic wall. In the case of stainless steel housings, as is generally the case, at least in Europe, the radar sensor can be fitted to a plastic insert, which is inserted into a recess in the washing chamber housing.

In one particular embodiment, the radar sensor is fitted to an insert part, which is already used in any case in conventional dishwashers at the moment. This may be, for example, the plastic insert which is already arranged on the sump of the dishwasher and contains filter inserts. Another option is also to integrate the radar sensor in a metering apparatus for detergent.

In principle, the radar sensor can be fitted anywhere where there is a window into the interior of the stainless steel housing, so that the radar beams are not screened.

The radar sensor is advantageously arranged in the door of the dishwasher. In this case, the radar sensor is fitted in the physical vicinity of the electronic controller, which normally arranged in the door area, so that the connecting lines can be fitted without any problems.

An arrangement such as this is present in the door area, especially in conjunction with the metering apparatus, since this arrangement is already accommodated in the door area, for simple filling and for operation via the machine controller.

The radar sensor allows program control of the dishwasher as a function of the widely different parameters which can be detected by means of the radar sensor. An appropriately designed evaluation and control unit is advantageously provided for this purpose. The evaluation itself can be carried out, for example, by comparing the measurement spectrum with a reference spectrum recorded in predetermined operating conditions.

This allows a large number of monitoring processes to be carried out using one and the same sensor. If necessary, a number of sensors can also be used, for different monitoring tasks. It is also feasible to use a sensor with different emission frequencies, in order to achieve more versatile use. In addition to a radar sensor arranged in a fixed position, it would invariably also be possible to use a moving sensor, although a rigidly fitted sensor is to be preferred, owing to the corresponding reduction in the manufacturing complexity.

The radar sensor can be used, for example, for spray arm monitoring, in order to detect whether a spray arm is rotating correctly inside the dishwasher or whether its rotation is being interfered with, or in the worst case is even being blocked. In this case, if the defect cannot itself be rectified, an alarm signal is produced for the machine operator.

A radar sensor can also be used to detect the load state of the dishwasher. This is done either by using standing waves or else by using the relative movement between the dish basket and the sensor, making use of the Doppler effect for load monitoring. The monitoring process could, for example, be carried out during the process of closing the door, if the sensor is arranged in the dishwasher door.

It would also be possible to use the radar sensor according to the invention to monitor the filling level. This can be done either by directly using the reflection from the liquid surface or else by using secondary effects, for example the influence on the vibration response of the washing chamber housing caused by the filling level.

A radar sensor according to the invention can also be used for foam monitoring or for spray pattern monitoring during the washing process. The surface of water droplets are used as reflection or refraction surfaces, so that the radiation pattern which is detected by the sensor is considerably influenced by this.

Furthermore, various data can be detected by means of the radar sensor, which is noticeable by virtue of secondary effects, for example the influence on the vibration response of the machine.

As for example, it would be feasible to monitor bearings, for example of the water pump or the state of filters, by measuring such secondary effects.

Temperature measurement would also be feasible. A temperature measurement could be carried out, in particular, by means of such secondary effects, for example by detecting the vibration response of a test body or by detecting temperature-dependent length expansions.

Furthermore, the radar sensor could be used to monitor the amount of dirt, the circulation or some other state of the washing liquid. The state of the washing liquid influences the reflections of the infected radiation, as does the configuration of the surface, so that this can also be used to carry out monitoring by means of the radar sensor.

In principle, all dishwasher units can be monitored for correct operation by means of a radar sensor, in which case it is either possible to detect the state of individual components directly, or else to detect secondary effects, as stated above.

In addition to said function, a radar sensor can also advantageously be used to detect the moisture content or vapor level. This is advantageous, for example, in order to detect a drying profile and, possibly, for controlling the dishwasher. The moisture content inside the washing chamber can have a direct influence on the sensor signal, or can be detected indirectly via further parameters, for example the droplet size, the state of a test body or the like. The droplet size and shape or state data of a test body wetted with the washing liquid can also, for example, be used in order to make statements on the state of the washing liquid, for example its detergent content.

A test body which reacts to the respective measurement variable and whose state changes can be detected by the radar sensor can in general also be used for detecting other measurement variables.

Furthermore, a radar sensor according to the invention also makes it possible to monitor the state of the ion exchanger, which must be regenerated at the latest when its ion exchanger capacity is exhausted.

The brine which is normally used for regeneration of an ion exchanger in the dishwashing machine can also be monitored using a radar sensor. The brine state can in this case be measured directly by the influence of the charge carriers contained in it on the sensor signal, or else by means of the state of a float in the interior of the brine container.

One further advantageous use of a radar sensor is detection of the detergent level in an appropriate metering appliance. This can be used, for example, to produce an alarm signal if the detergent needs replenishment. This application is also particularly advantageous in the case of dishwashers which can hold a supply of detergent for a number of dishwashing cycles. This is already prior art for the metering of liquid rinsing agents. However, in principle, corresponding multiple washing cycles are also feasible for the addition of cleaners.

Finally, a radar sensor can also be used for flow measurement inside a line. Flow measurement is already carried out in present-day dishwashers by widely different means, and is used for widely differing purposes. By way of example, flow measurement has been required for a long time in connection with the hardness level of the tap water being supplied, in order to determine the state of the ion exchanger.

The use of waveguides, which open at the appropriate outlet point, would also be feasible in order to use the radar sensor objectively at different locations. The radiation lobe of sensor can likewise be shaped by appropriate configuration of the antenna with or without a waveguide, such that one or more areas in the interior of the dishwasher are illuminated objectively.

BRIEF DESCRIPTION OF THE DRAWINGS

An exemplary embodiment is illustrated in the drawing, and will be explained in more detail in the following text with reference to the figures.

In detail:

FIG. 1 shows a schematic cross section of the dishwasher 1 with a washing chamber 2. Dish baskets 3, 4 are located in the washing chamber 2 under each of which a spray arm 5, 6 is arranged, such that it can rotate.

DETAILED DESCRIPTION OF THE PRFERRED EMBODIMENT

Figure 1:
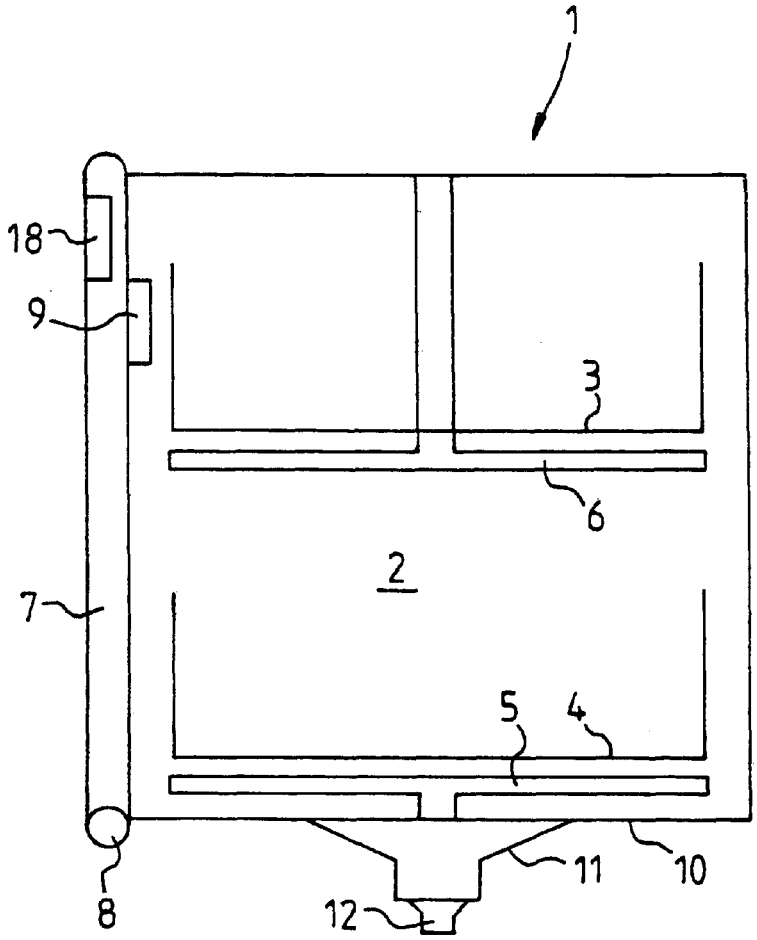
FIG. 1 shows a schematic cross section through a dishwasher.

A dishwasher door 7 is fitted to the front face such that it can rotate, as is indicated by a rotation shaft 8. A metering apparatus 9 for adding detergent is located in the dishwasher door 7.

A sump container 11 is located in the base 10 of the dishwasher 1 and contains, for example, the normal filters and water outlet.

In the present exemplary embodiment, a radar sensor 12 is provided underneath the sump container 11 and illuminate the entire interior of the washing chamber 2, in this arrangement.

Figure 2:
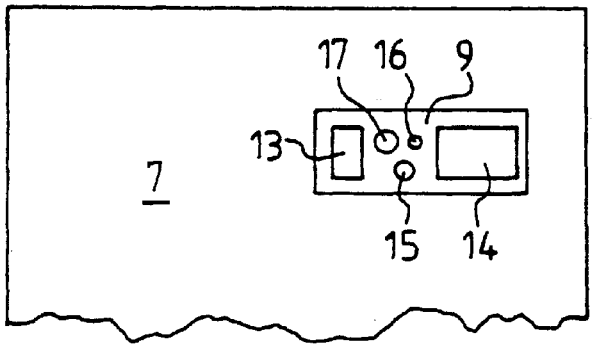
FIG. 2 shows a plan view of the inside of the door of a dishwasher.

FIG. 2 shows a further option for the arrangement of a radar sensor 13. In this case, the radar sensor 13 is located in the metering apparatus 9 which, in the normal way, comprises a flap 14 for closing a detergent chamber, an outlet opening 15 for metering the rinsing agent, and a viewing glass 16 and a replenishment opening 17 for the rinsing agent. The metering apparatus 9, which has already been described with reference to FIG. 1, is inserted into the dishwasher door 7. The evaluation and control unit can also be arranged in the interior of this door, as is indicated in FIG. 1. At the location of the evaluation and control unit 18 indicated in FIG. 1, this can be connected directly to the keys and other operating members required to operate the machine.

The dishwasher according to the invention can be controlled as a function of the respective operating conditions. Thus, for example, the amount of water and the amount of detergent can be metered depending on the load level. The pump pressure can be varied as a function of the spray pattern recorded in the interior of the dishwasher. If required, even controllable nozzles are feasible. The spray pattern could be varied as a function of the type of dishes located in the interior since, normally, pots and pans produce a different sensor signal from, for example, glasses or porcelain. The duration of the individual process steps can also be varied as a function of such parameters. Thus, for example, the dirt content of the washing water can also be used to control the machine in order, if required, also to introduce a further washing step into the washing program.

In principle, the sensor signal is available for evaluation of all possible desired information provided only that, according to the invention, a radar sensor is fitted to the dishwasher or to an insert part in the dishwasher.

LIST OF REFERENCE SYMBOLS

1 Dishwasher
2 Washing chamber
3 Dish basket
4 Dish basket
5 Spray arm
6 Spray arm
7 Dishwasher door
8 Rotation shaft
9 Metering apparatus
10 Base
11 Sump container
12 Radar sensor
13 Radar sensor
14 Flap
15 Outlet opening
16 Viewing glass
17 Replenishment opening
18 Evaluation and control unit

What is claimed is:

1. A dishwashing machine, comprising:

an electromagnetic sensor unit, which includes a transmitter and a receiver; and a washing chamber, wherein the electromagnetic sensor unit comprises at least one Doppler radar sensor directed at the washing chamber.

2. The dishwashing machine according to claim 1, wherein the at least one radar sensor emits radar signals and includes a waveguide for specific emission of the radar signals.

3. The dishwashing machine according to claim 2, further comprising an evaluation and control unit for evaluation of the signals from the at least one radar sensor and for control of a program sequence of the dishwashing machine, taking into account of the information obtained from the evaluation.

4. The dishwashing machine according to claim 3, wherein at least one washing chamber wall includes a recess and the at least one radar sensor is arranged on an insert part which can be inserted into the recess.

5. The dishwashing machine according to claim 1, wherein the washing chamber comprises walls, at least one of the wall being composed at the least partially of plastic, and the at least on radar sensor is arranged behind the plastic, outside the washing chamber.

6. The dishwashing machine according to claim 1, further comprising a sump container located at a base of the dishwashing machine and the at least one radar sensor being arranged on a plastic part surrounding the sump container.

7. The dishwashing machine according to claim 1, further comprising a metering apparatus for adding detergent and rinsing agent, the at least one radar sensor being fitted to the metering apparatus.

8. The dishwashing machine according to claim 7, wherein the at least one radar sensor detects a detergent level in the metering appliance.

9. The dishwashing machine according to claim 1, further comprising a door and the at least one radar sensor being arranged in the door.

10. The dishwashing machine according to claim 1, further comprising at least one spray arm and at least one dish basket for loading dishes located in the washing chamber under each of the at least one spray arm and wherein the at least one radar sensor monitors the operation of the at least on spray arm.

11. The dishwashing machine according to claim 10, wherein the at least one radar sensor monitors the dishes located in the at least one dish basket.

12. The dishwashing machine according to claim 1, wherein the at least one radar sensor monitors a filling level in the washing chamber.

13. The dishwashing machine according to claim 1, wherein the at least one radar sensor monitors foam and spray pattern in the washing chamber.

14. The dishwashing machine according to claim 1, wherein the at least one radar sensor detects a defection of components of the dishwashing machine.

15. The dishwashing machine according to claim 1, wherein the at least one radar sensor detects a temperature inside the dishwashing machine.

16. The dishwashing machine according to claim 1, wherein the at least one radar sensor detects vibration of the washing chamber.

17. The dishwashing machine according to claim 1, wherein the least one radar sensor detects the moisture content in the washing chamber.

18. The dishwashing machine according to claim 1, further comprising a brine for regenerating an ion exchanger and the at least one radar sensor monitoring the operation of the brine.

19. The dishwashing machine according to claim 1, wherein the at least one radar sensor detects cloudness of washing liquid in the washing chamber.

20. The dishwashing machine according to claim 19, wherein the at least one radar sensor detects a detergent content in the washing liquid.

21. The dishwashing machine according to claim 1, wherein the at least one radar sensor measures a fluid flow in the washing chamber.

22. An insert element for inserting into a recess in at least one wall of a washing chamber of a dishwashing machine, comprising at least one radar sensor, the at least one radar sensor emitting radar signals and the insert element being made at least partially of a material which does not block the radar signals.

* * * * *